United States Patent [19]

Walker

[11] Patent Number: 4,817,316

[45] Date of Patent: Apr. 4, 1989

[54] SIGN ASSEMBLY

[76] Inventor: Robert E. Walker, 2824 Brighton Ct., Westchester, Ill. 60153

[21] Appl. No.: 51,296

[22] Filed: May 18, 1987

[51] Int. Cl.[4] ..... G09F 13/04

[52] U.S. Cl. ..... 40/576; 40/5; 40/568; 40/649

[58] Field of Search ..... 40/575, 576, 579, 568, 40/5, 16, 16.4, 618, 649

[56] References Cited

U.S. PATENT DOCUMENTS

| | | | |
|---|---|---|---|
| 1,521,177 | 12/1924 | Friis et al. | 40/576 |
| 2,587,368 | 2/1952 | Murphy | 40/618 |
| 3,742,633 | 7/1973 | Palm | 40/576 |
| 4,174,580 | 11/1979 | Sanders et al. | 40/16.4 |
| 4,177,588 | 12/1979 | Gebhardt et al. | 40/16.4 |
| 4,553,345 | 11/1985 | Bercier et al. | 40/576 |
| 4,693,026 | 9/1987 | Callahans et al. | 40/576 |

*Primary Examiner*—Carlton R. Croyle
*Assistant Examiner*—Eugene L. Szczecina, Jr.
*Attorney, Agent, or Firm*—Marshall, O'Toole, Gerstein, Murray & Bicknell

[57] ABSTRACT

A changeable copy sign assembly comprising a plurality of wafers each bearing a single indicium on a relatively opaque background. The wafers and a backing strip are removeably retained to a face plate of the assembly at an elongated, window-like opening, and the backing strip comprises opaque makings for preventing the leakage of light between adjacent wafers.

6 Claims, 1 Drawing Sheet

SIGN ASSEMBLY

BACKGROUND OF THE INVENTION

The present invention relates generally to sign assemblies, and more particularly to backlighted, changeable copy, sign assemblies.

Backlighted sign assemblies are often used as menu boards in restaurants, delicatessens or cafeterias. They can also be used as directory boards in apartment or office buildings. A light source within the assembly directs light through a face plate of the assembly, illuminating indicia on the face plate but leaving relatively dark a background area surrounding the indicia. Such assemblies offer an attractive and stylish manner of displaying information constituting a pre-arranged sequence of indicia.

Information, such as menu items or tenant names, can be silk-screened onto custom strips which are often used with such assemblies. The strips are removeably retained to the assembly at an elongated window-like opening on the face plate. However, because the information presented on such boards frequently must be changed, the time and expense necessary in preparing such strips makes reliance on their use inconvenient.

The use of a multiplicity of individual wafers in connection with such assemblies is referred to as changeable copy. Each wafer bears at least one indicium, such as an individual letter, and a multiplicity of wafers can be combined to present the desired information. However, the use of such wafers on sign assemblies having the window-like openings necessary to accommodate custom strips results in undesirable light leakage between adjacent wafers.

SUMMARY OF THE INVENTION

The present invention provides a simple solution to the problem of light leakage in backlighted, changeable copy, sign assemblies. The sign assembly has an elongated window-like opening, allowing the use of custom strips when available or desirable.

To provide changeable copy, the device comprises a removeable backing strip which is retained to the face plate at the window-like opening. Wafers are retained to the face plate in front of the backing strip. The backing strip includes means which prevents light leakage between adjacent wafers.

Other features and advantages are inherent in the structure claimed and disclosed or will become apparent to those skilled in the art from the following detailed description in conjunction with the accompanying drawings.

DETAILED DESCRIPTION

Figure 1:
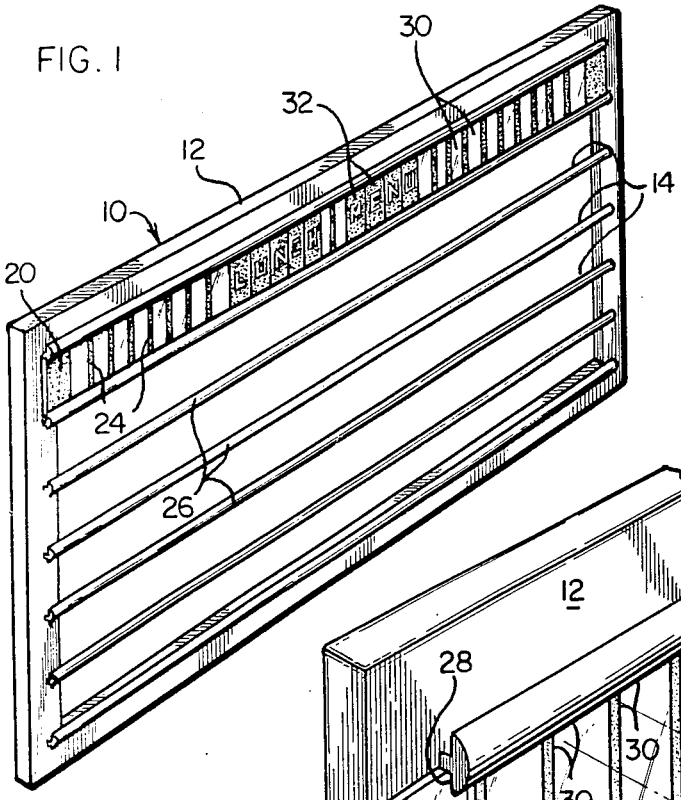
FIG. 1 is a perspective of a face plate for a sign assembly in accordance with an embodiment of the present invention.

Referring initially to FIG. 1, indicated generally at 10 is a backlighted, changeable copy, sign assembly in accordance with the present invention. Sign assembly

10 comprises a face plate 12 having six elongated window-like openings 14, 14. Each opening 14 may be an aperture or may be a portion of face plate 12 which is relatively non-opaque compared to the surrounding portions of the face plate.

Figure 4:
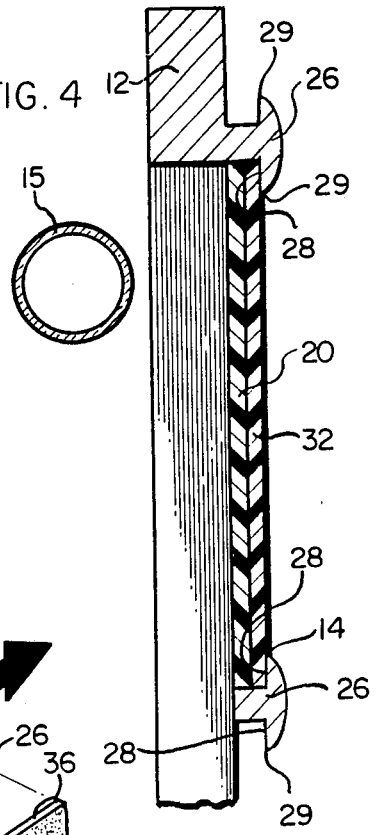
FIG. 4 is an enlarged, sectional view taken along line 4—4 of FIG. 3.

In sign assembly 10, face plate 12 is positioned in front of a light source 15, such as a fluorescent tube (FIG. 4). Light source 15 directs light forwardly through openings 14, 14 on face plate 12.

Figure 2:
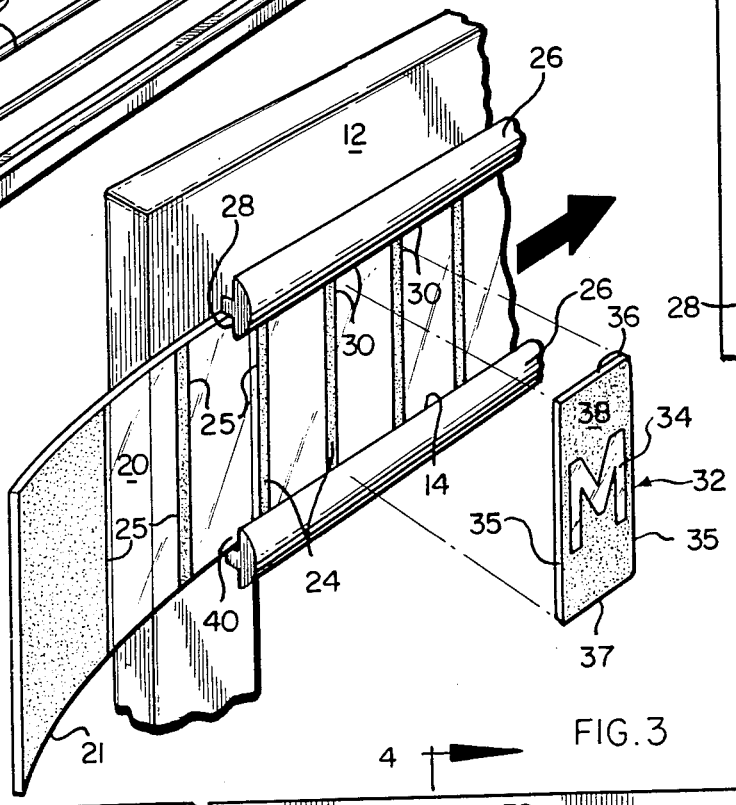
FIG. 2 is an enlarged, fragmentary perspective showing a portion of the sign assembly.
Figure 3:
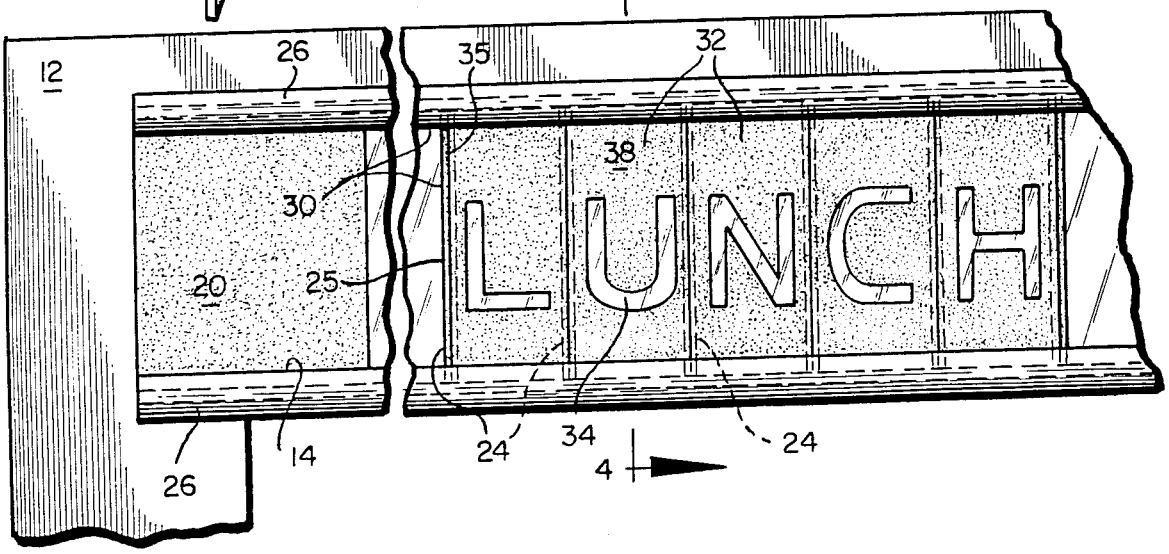
FIG. 3 is an enlarged, fragmentary, front view of the sign assembly.

An elongated backing strip 20 is retained to face plate 12 at an opening 14. Backing strip 20 is preferably made of a clear flexible plastic and comprises a series of lateral markings 24, 24 which are relatively opaque. As shown in FIG. 2, lateral edges 25, 25 of adjacent markings 24, 24 are separated by equal distances along the length of backing strip 20.

Face plate 12 comprises rails 26, 26 which project in front of face plate 12 and extend along the length of each opening 14. Rails 26, 26 retain backing strip 20 to face plate 12. Each rail 26 has upper and lower longitudinal edges 29, 29. As seen more clearly in FIG. 4, each rail 26 defines a slot 28 adjacent the longitudinal edge of opening 14.

Backing strip 20 has longitudinal edges 21 21 which fit within slots 28, 28. Backing strip 20 slides within these slots along the length of opening 14, across face plate 12, and into or out of contact with rails 26, 26 at an open end 40 of slots 28, 28 (FIG. 2).

Where longitudinal backing strip 20 is retained to face plate 12 at an opening 14, markings 24, 24 on backing strip 20 extend laterally across opening 14, dividing the opening into a series of custom openings 30, 30. Each custom opening 30 has lateral edges defined by lateral edges 25, 25 of adjacent opaque markings 24, 24, and a length determined by the distance between those lateral edges. All custom openings 30, 30 are of equal length.

One embodiment of sign assembly 10 comprises a plurality of equally-sized wafers 32, 32, each preferably constructed of flexible plastic. Each wafer 32 bears a single indicium 34 comprising a single alphanumeric character. Wafer 32 has a pair of side edges 35, 35 and top and bottom edges 36, 37, respectively. The distance between side edges 35, 35 is greater than the length of a custom opening 30, and the distance between top and bottom edges 36, 37 is greater than the vertical or lateral distance between the nearest edges 29, 29 of adjacent rails 26, 26. Each wafer 32 comprises a background 38 which is relatively opaque compared to the wafer's indicium 34.

Wafers 32, 32 are attached to face plate 12 at custom openings 30, 30 in either of two ways. Wafer 32 may be flexed along its height (i.e. its dimension in the lateral direction of the sign assembly), and top and bottom wafer edges 36, 37 inserted into slots 28, 28 between backing strip 20 and rails 26, 26. Or, wafer 32 may be attached to face plate 12 without being flexed by positioning the wafer at open ends 40, 40 of slots 28, 28 and sliding the wafer longitudinally along rails 26, 26 across face plate 12. Each wafer 32 is then retained to the face plate by those rails.

Wafers 32, 32 are retained adjacent one another along the length of opening 14, as illustrated in FIG. 4. Opposite side edges 35, 35 of each wafer 32 are positioned in front of adjacent markings 24, 24. These markings are relatively opaque compared to indicium 34 on the wafer, and the opaque markings prevent the leakage of light from behind backing strip 20 forwardly between adjacent wafers 32, 32.

Each wafer 32 can be removed from face plate 12 by sliding it longitudinally across face plate 12 beyond open ends 40, 40 of slots 28, 28.

The desired information is displayed on sign assembly 10 by retaining to face plate 12 a sequence of wafers 32, 32 comprising the individual indicia 34, 34 necessary to form that information. In FIG. 1, for example, a sequence of wafers 32, 32 comprising the individual letters necessary to form the words "LUNCH MENU" have been adjacently retained to face plate 12. Price or suite number information can be formed using wafers comprising individual numbers.

In many instances, it will not be necessary to utilize each custom opening 30 to display the desired information. Each unnecessary custom opening 30 and each custom opening 30 between words may be covered with a blank, not shown. Such blanks do not comprise any indicia, and are sized and constructed to block the passage of light through one or more custom openings. Each blank can be removeably retained to face plate 12 at one or more custom openings 30, 30 in the same manner as is a custom strip or wafer. Each blank is positioned so that markings 24, 24 on backing strip 20 prevent light leakage between the blank and adjacent blanks or wafers.

The foregoing detailed description is provided for clearness of understanding only, and no unnecessary limitations should be understood therefrom, as modifications will be obvious to those skilled in the art.

I claim:

1. A backlighted sign assembly comprising:

at least one face plate, said face plate comprising at least one elongated window-like opening;

retaining means for removeably retaining a custom strip of information to said face plate at said window-like opening when use of such a custom strip is desired;

a removable backing strip;

said retaining means for removeably retaining said backing strip to said face plate at said window-like opening when use of changeable copy is desired;

at least two wafers, each wafer comprising a background and at least one indicium;

said background of each of said wafers being relatively opaque compared to said indicium, said retaining means for adjacently retaining said wafers to said face plate at said window-like opening; and means on said backing strip for preventing the leakage of light from behind said backing strip forwardly between said adjacent wafers.

2. A sign assembly as recited in claim 1, wherein said means on said backing strip for preventing the leakage of light comprises:

means for defining, in said window-like opening, at least one custom opening for lesser length than the length of said window-like opening.

3. A sign assembly as recited in claim 2, wherein said means on said backing strip for defining said custom opening comprises:

at least two markings;

each of said markings being relatively opaque compared to said indicium;

said markings extending laterally across said window-like opening when said backing strip is removeably retained to said face plate; and the lateral edges of said markings defining the lateral edges of said custom openings.

4. A sign assembly as recited in claim 3, wherein:

said means for removeably retaining said backing strip comprises means mounting said backing strip for removal by sliding said backing strip across said face plate and out of contact with said retaining means; and said retaining means for said wafers comprises means mounting said wafers for removal by sliding said wafers across said face plate and out of contact with said retaining means.

5. A sign assembly as recited in claim 3, wherein:

said backing strip is made of flexible plastic;

the indicium on at least two of said wafers comprises a single alphanumeric character; and at least two of said custom openings are of equal length.

6. A sign assembly as recited in claim 5, wherein:

said means for removeably retaining said backing strip comprises means mounting said backing strip for removal by sliding said backing strip across said face plate and out of contact with said retaining means; and said retaining means for said wafers comprises means mounting said wafers for removal by sliding said wafers across said face plate and out of contact with said retaining means.

* * * * *